US008998640B1

(12) United States Patent
Mitchell, Jr.

(10) Patent No.: US 8,998,640 B1
(45) Date of Patent: Apr. 7, 2015

(54) RADIO FREQUENCY CONNECTORS FOR PASSIVE INTERMODULATION (PIM) PREVENTION

(71) Applicant: Sprint Communications Company L.P., Overland Park, KS (US)

(72) Inventor: Eugene S. Mitchell, Jr., Blue Srings, MO (US)

(73) Assignee: Sprint Communications Company L.P., Overland Park, KS (US)

( * ) Notice: Subject to any disclaimer, the term of this patent is extended or adjusted under 35 U.S.C. 154(b) by 247 days.

(21) Appl. No.: 13/692,475

(22) Filed: Dec. 3, 2012

(51) Int. Cl.
*H01R 9/05* (2006.01)
*H01R 43/20* (2006.01)

(52) U.S. Cl.
CPC . *H01R 9/05* (2013.01); *H01R 43/20* (2013.01)

(58) Field of Classification Search
USPC ..... 439/578–585, 564, 97, 573, 551, 801, 439/697, 737, 782, 797, 809, 906, 465
See application file for complete search history.

(56) References Cited

U.S. PATENT DOCUMENTS

2006/0046564 A1 * 3/2006 Stanford et al. ..... 439/578

* cited by examiner

*Primary Examiner* — Edwin A. Leon

(57) ABSTRACT

An apparatus, system, and method for preventing passive intermodulation (PIM) in radio frequency (RF) connectors are provided. RF connectors that function in a telecommunication environment are re-designed and forged to have tags or portions that extend from the body. The tags or portions have holes that can receive screws to secure RF connectors together are secure an RF connector to a device. The screws are placed in the RF connectors and are connected together with safety wire such that a loosening motion of one screw causes a tightening motion on another screw.

13 Claims, 4 Drawing Sheets

RADIO FREQUENCY CONNECTORS FOR PASSIVE INTERMODULATION (PIM) PREVENTION

CROSS-REFERENCE TO RELATED APPLICATIONS

Not applicable.

BACKGROUND OF THE INVENTION

Today, the vast majority of all radio frequency (RF) network passive intermodulations (PIMs) are caused by RF connectors. With the aging process, the RF connectors become loose by expansion and contraction, due to environmental temperature changes. Small layers of corrosion build up between the male and female portions of the connectors, due to moisture and the lack of a "hard contact" required to prevent corrosion. The loss of the "hard contact" also results from tower vibrations and cables flexing. As a result, PIMs cause networks providers to lose money in lost revenue because of the interference. The type of interference is usually the result of non-linear signals or harmonics that occur. Therefore, a solution is desired that would not only reduce PIM, but prevent PIM altogether.

SUMMARY

Embodiments of the invention are defined by the claims below, not this summary. A high-level overview of various aspects of embodiments of the invention is provided here for that reason, to provide an overview of the disclosure and to introduce a selection of concepts that are further described below in the detailed description section. This summary is not intended to identify key features or essential features of the claimed subject matter, nor is it intended to be used as an aid in isolation to determine the scope of the claimed subject matter.

Embodiments of the present invention relate generally to an apparatus, system, and method for passive intermodulation (PIM) prevention. Accordingly, the present invention implements changes to RF connectors to prevent PIM. Safety wired RF connectors are implemented in a telecommunication environment.

Upwards of sixty (60%) of PIM can be reduced by implementing embodiments of the present invention. A small tab with a safety wire hole can be implemented in RF connectors to secure the RF connector in position. The safety wire can be approximately 0.032 inches in diameter and the safety wire hole can be approximately 0.045 inches in diameter. The safety wire and the RF connector can be made of the same metallic material to prevent dissimilar metallic corrosion.

BRIEF DESCRIPTION OF THE SEVERAL VIEWS OF THE DRAWINGS

Illustrative embodiments of the present invention are described in detail below with reference to the included drawing figures, wherein.

DETAILED DESCRIPTION

Embodiments of the present invention relate generally to an apparatus, system, and method for passive intermodulation (PIM) prevention. Accordingly, the present invention implements changes to RF connectors to prevent PIM. Safety wired RF connectors are implemented in a telecommunication environment.

Figure 1:
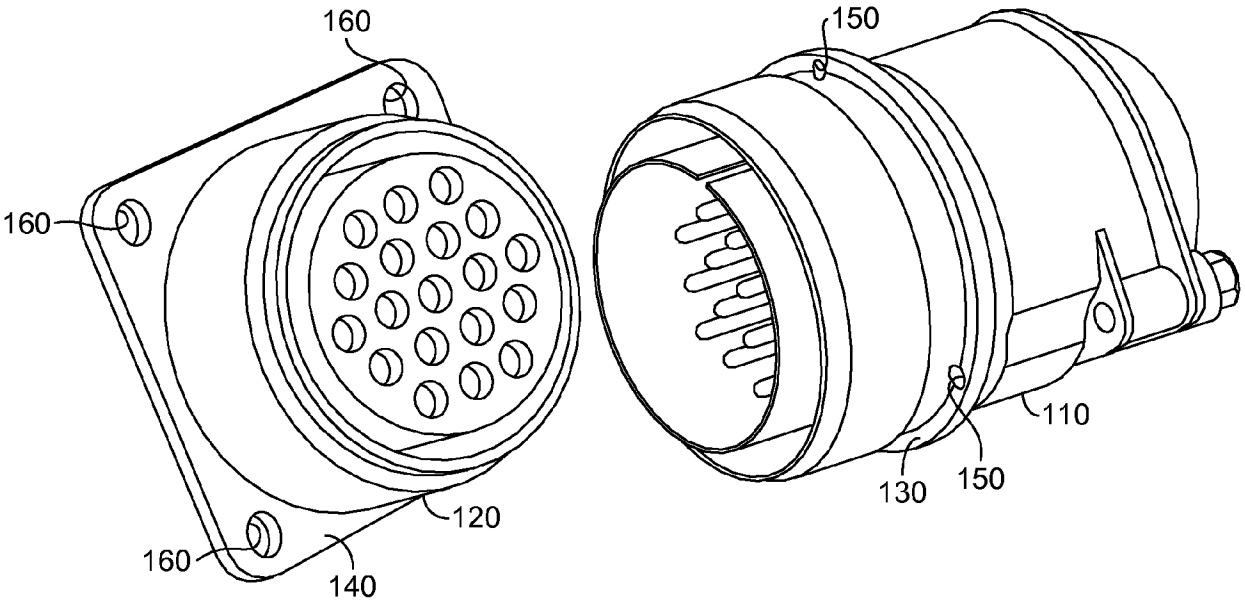
FIG. 1 is an exemplary view of radio frequency connectors, implemented in accordance with an embodiment of the present invention.

In FIG. 1, connectors 100 are shown with a male connector 110 and a female connector 120. Male connector 110 and female connector 120 connect in a sealed fashion. Male connector 110 and female connector 120 have metallic tabs 130 and 140 that extend outward from the surface of the connectors. As one can see, the metallic tabs can extend evenly or extend substantially in some areas versus other areas. Metallic tabs 130 and 140 are forged from the same material as male connector 110 and female connector 120. Metallic tab 130 has a set of holes 150 that are spaced around the circumference of male connector 110. The holes 150 can be spaced evenly either with three holes spaced at 120 degrees or with four holes spaced at 90 degrees. Metallic tab 140 also has a set of holes 160 that are spaced around the circumference of female connector 120. Similar to holes 150, holes 160 are spaced accordingly.

In an implementation of an embodiment of the present invention, male connector 110 and female connector 120 connect such that holes 150 and 160 line up together. Therefore, in addition to the connection made by the two connectors with their male and female parts, holes 150 and 160 provide an additional way to secure male connector 110 and female connector 120 together.

One of ordinary skill understands that various types of connectors may be implemented in embodiments of the present invention. The connectors are re-designed to be used in a wireless telecommunication network. Some of the connectors that can be re-designed and improved to operate to prevent PIM include a Concelman (C)-connector, F-connector, Neill (N)-connector, Bayonet Neill-Concelman (BNC) connector, DIN connector, SubMiniature version A (SMA) connector, threaded Neill-Concelman (TNC) connector, Ultra High Frequency (UHF) connector, or other type of connector found in an operating environment where a radio frequency (RF) is used.

Figure 2:
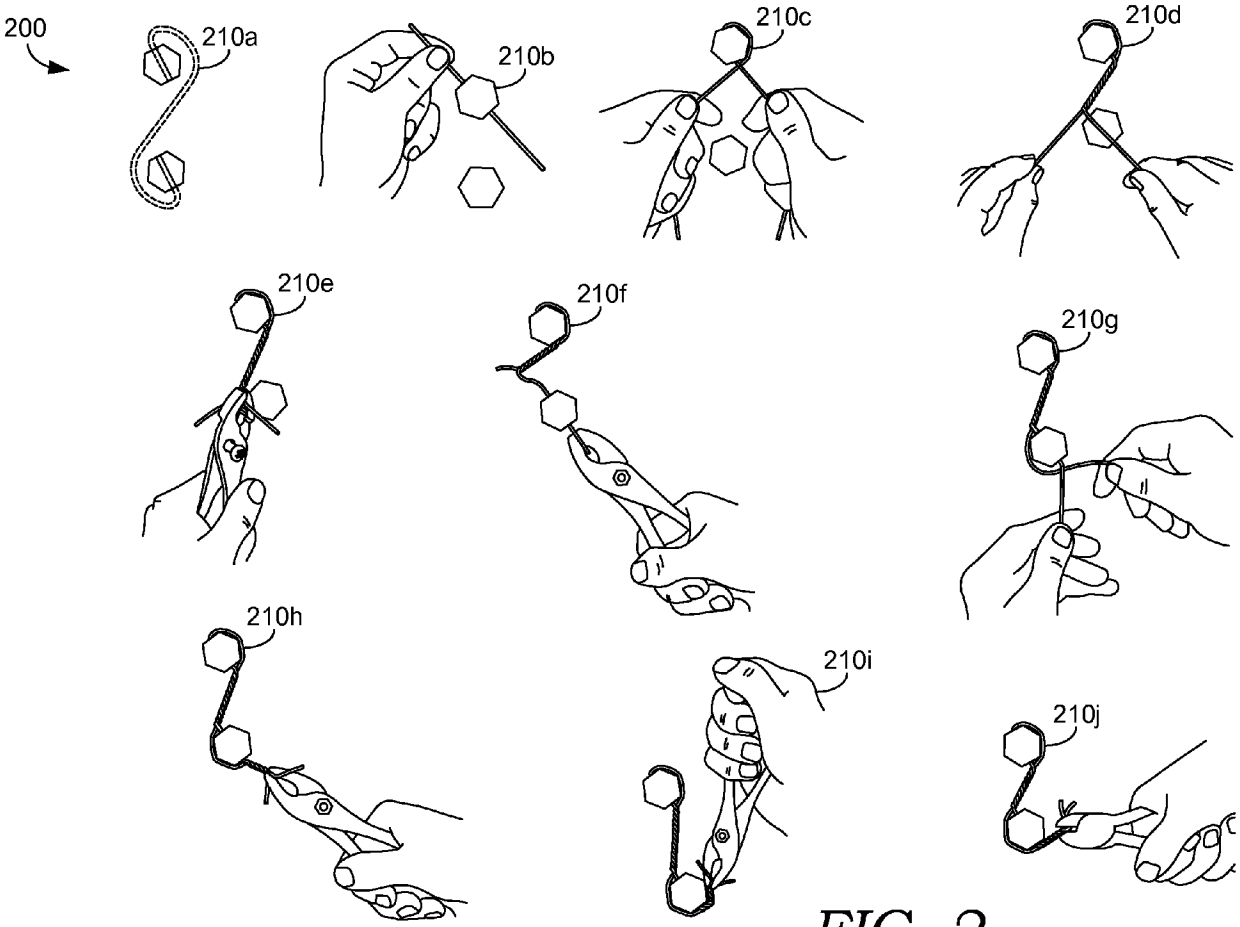
FIG. 2 is exemplary views of safety wires implemented in accordance with an embodiment of the present invention.

Turning now to FIG. 2, illustrations 210*a*-210*j* are shown in a safety wire implementation 200. Safety wire implementation 200 shows illustrations of how safety wire is used with connectors 110 and 120 to keep a secure contact between connectors 110 and 120. Illustration 210*a* shows how wire can be threaded through the heads of two fasteners, such as screws or bolts. For ease of discussion, the fasteners shall be referred to as screws, although other types of fasteners can be used. The wire connects the two screws together. Illustration 210*b* shows the wire being threaded through the head of a screw. Illustration 210*c* shows the wire is twisted together and wrapped around the head of the screw. Illustration 210*d* shows the twisted wire at the beginning stage of being wrapped around the head of a second screw. Illustration 210*e* shows a user using pliers to manipulate the twisted wire at the head of the second screw. Illustration 210*f* shows the wire being threaded through the head of the second screw. Illustration 210*g* shows the wire has being twisted and wrapped around the head of the second screw. Illustrations 210*h-j* are continuations of illustration 210*g* where the wire is being twisted with the pliers.

It is noted that the safety wire is typically made from the same metallic material as the RF connector to prevent dissimilar metallic corrosion. As a result, this prevention of metallic corrosion aids in preventing PIM.

Figure 3:
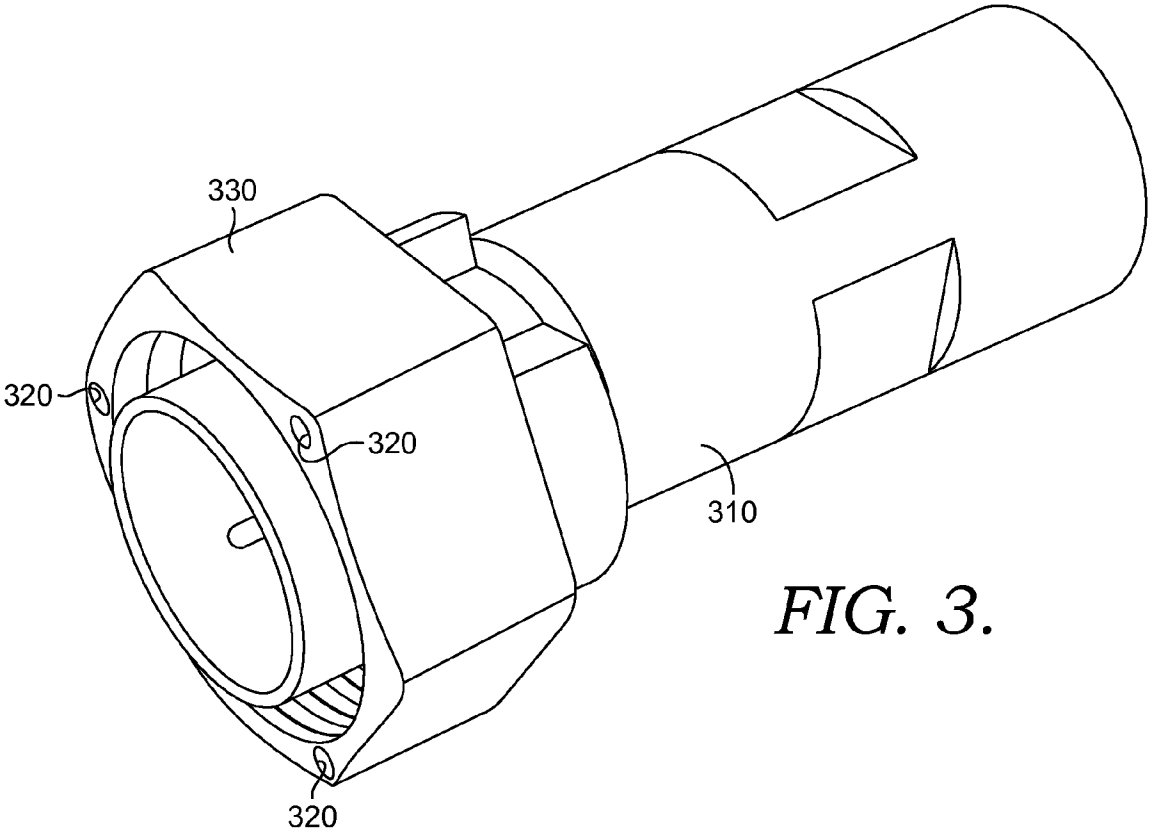
FIG. 3 is an exemplary view of another RF connector implemented in accordance with an embodiment of the present invention.

In FIG. 3, a connector 300 is shown that is similar to the connectors in FIG. 1. Connector 300 is another exemplary version of a connector implemented in an embodiment of the present invention. Connector 300 has a shaft 310 that extends lengthwise. At one end of shaft 310, head 330 extends outward and perpendicular to shaft 310. As one can see, head 330 is a metallic portion that is similarly forged to the same material as the rest of connector 300. In addition, head 330 is integrated into connector 300 with other parts, such as shaft 310. In various embodiments, head 330 can have a narrow width, or have a wide width as shown. Head 330 has a set of holes 320 that are spaced around a circumference of connector 300. Holes 320 can be spaced evenly in head 330 or can be spaced in another configuration. Holes 320 can also be located to pass through to the opposite unseen side in head 330. As one can see, connector 300 is shown as a male connector, similar to connectors used with a coaxial cable. Connector 300 can be connected to a female connector or a device. The connection can involve a twisted motion that initially seals connector 300 to the other connector or device. This action can be followed by using a set of screws to further seal connector 300 to the other connector or device.

In an implementation of an embodiment of the present invention, a coaxial cable system operates in a wireless telecommunication environment with various connectors. For example, a base station, base transceiver station, radio network controller, cell site, or similar system operates to reach subscribers or a mobile switching center. Typically, many cell sites operate in the field providing wireless coverage to offer wireless service to subscribers. In the field environment, connectors, such as connector 100 and 300, can become loose allowing corrosion to form where the contact is loose. Connectors become loose over time due to various factors, such as the vibration of equipment or the change in temperature causing materials to expand and contract. The development of corrosion or the loose connection can give rise to passive intermodulation. The corrosion occurs as a result of oxidation that occurs with the metal.

Implementations of embodiments of the present invention overcome passive intermodulation by forging the connectors to have tabs with holes to secure the connectors to each other or devices. Connectors are secured tightly to each other or to devices to prevent loosening. Screws are used with safety wire to secure the connectors. In FIG. 3, a screw can be inserted in holes 320 from the opposite unseen side in head 330. The screw is inserted from this end to prevent pinching, squeezing, or compromising the safety wire when the two connectors are connected together, or when the connector is connected to a device.

Figure 4:
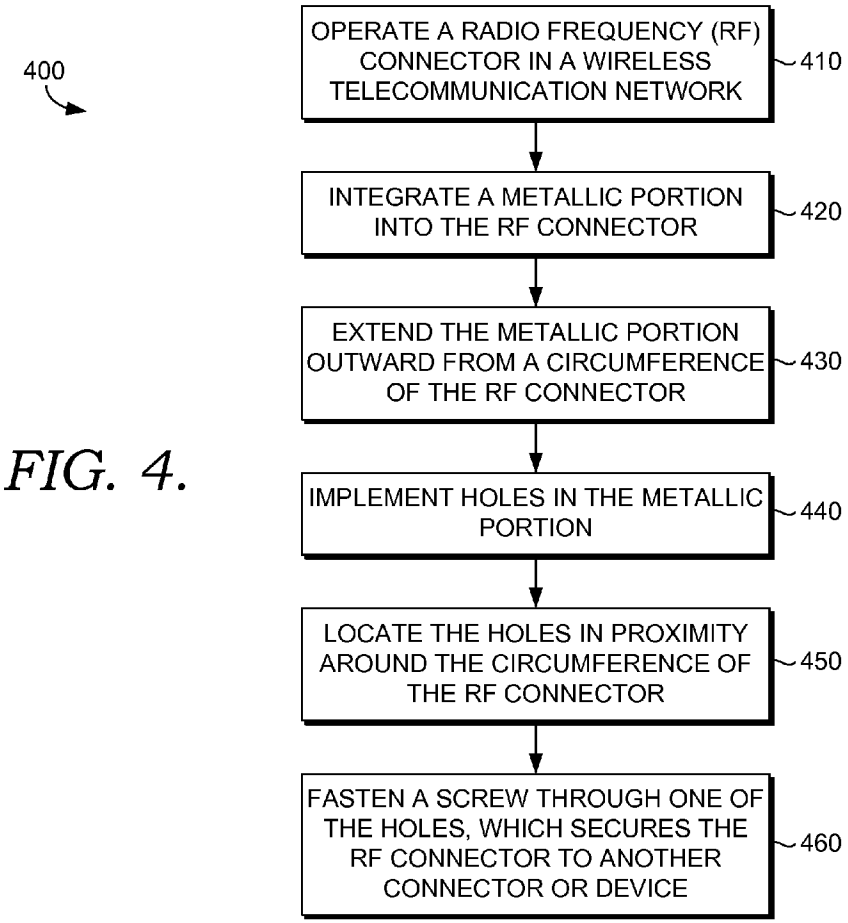
FIG. 4 is a process for implementing passive intermodulation prevention, in accordance with an embodiment of the present invention.

Turning now to FIG. 4, a process for preventing PIM is implemented in a method 400. In a step 410, RF connector 110 operates in a wireless telecommunication network. A metallic portion 130 integrates into RF connector 110, in a step 420. In a step 430, metallic portion 130 extends outward from a circumference of RF connector 110. In a step 440, metallic portion 130 has a set of holes 150. Holes 150 are located around the circumference of RF connector 110, in a step 450. In a step 460, a screw is fastened through one of the holes 150. The fastening process secures RF connector 110 to RF connector 120 or a device.

Many different arrangements of the various components depicted, as well as components not shown, are possible without departing from the spirit and scope of embodiments of the present invention. Embodiments of the present invention have been described with the intent to be illustrative rather than restrictive. Certain features and subcombinations are of utility and may be employed without reference to other features and subcombinations and are contemplated to be within the scope of the claims.

The invention claimed is:

1. An apparatus for passive intermodulation (PIM) prevention at a radio frequency (RF) connector, comprising:

the RF connector functions in a wireless telecommunication network;

a metallic portion is integrated into the RF connector and extends outward perpendicular from a lengthwise portion of the RF connector, wherein the metallic portion is comprised of a same metal as the RF connector; and one or more holes are located in the metallic portion such that a screw can pass through a hole and secure the RF connector to another connector or device, wherein the one or more holes are located around a circumference of the RF connector.

2. The apparatus of claim 1, further comprising:

a wire that runs through the heads of two or more screws that are secured at the RF connector such that if one screw loosens at the RF connector another screw tightens at the RF connector, wherein a counterclockwise rotation of the screw causes the wire to pull the another screw in a clockwise rotation.

3. The apparatus of claim 2, wherein the RF connector is selected from a group including a Concelman (C)-connector, F-connector, Neill (N)-connector, Bayonet Neill-Concelman (BNC) connector, DIN connector, SubMiniature version A (SMA) connector, threaded Neill-Concelman (TNC) connector, and Ultra High Frequency (UHF) connector.

4. The apparatus of claim 2, further comprising the RF connector connected to a coaxial cable.

5. A system for passive intermodulation (PIM) prevention, comprising:

a male radio frequency (RF) connector and a female RF connector operate connected together in a wireless telecommunication network;

each of the male RF connector and the female RF connector has an integrated metallic portion that extends outward around a circumference of each of the male RF connector and the female RF connector, wherein the metallic portion is comprised of a same metal as the RF connector; and the metallic portion of the male RF connector and the female RF connector has one or more hole such that when the male RF connector and the female RF connector are connected, the one or more holes in each of the metallic portion of both connectors align together.

6. The system of claim 5, further comprising one or more screws respectively pass through the one or more holes of the metallic portion of both connectors and further secure the male RF connector and the female RF connector together.

7. The system of claim 6, further comprising:

a wire that runs through the heads of two or more screws such that if one screw loosens at the RF connector another screw tightens at the RF connector, wherein a counterclockwise rotation of the screw causes the wire to pull the another screw in a clockwise rotation.

8. The system of claim 7, wherein the RF connector is selected from a group including a Concelman (C)-connector, F-connector, Neill (N)-connector, Bayonet Neill-Concelman (BNC) connector, DIN connector, SubMiniature version A (SMA) connector, threaded Neill-Concelman (TNC) connector, Ultra High Frequency (UHF) connector.

9. The system of claim 7, further comprising the RF connector connected to a coaxial cable.

10. A method for implementing passive intermodulation (PIM) prevention, comprising:

operating a radio frequency (RF) connector in a wireless telecommunication network;

integrating a metallic portion into the RF connector, wherein the metallic portion is comprised of a same metal as the RF connector;

extending the metallic portion outward from a circumference of the RF connector;

implementing one or more holes in the metallic portion, wherein the one or more holes are located in proximity around the circumference of the RF connector; and fastening a screw through a hole of the one or more holes, which secures the RF connector to another connector or device.

11. The method of claim 10, further comprising:

passing a wire through the heads of the two or more screws that are secured at the RF connector such that if one screw loosens at the RF connector another screw tightens at the RF connector, wherein a counterclockwise rotation of the screw causes the wire to pull the another screw in a clockwise rotation.

12. The method of claim 11, wherein the RF connector is selected from a group including a Concelman (C)-connector, F-connector, Neill (N)-connector, Bayonet Neill-Concelman (BNC) connector, DIN connector, SubMiniature version A (SMA) connector, threaded Neill-Concelman (TNC) connector, Ultra High Frequency (UHF) connector.

13. The method of claim 11, further comprising connecting the RF connector to a coaxial cable.

* * * * *